US007601226B2

(12) United States Patent
Voges et al.

(10) Patent No.: US 7,601,226 B2
(45) Date of Patent: Oct. 13, 2009

(54) SLURRY BLASTING APPARATUS FOR REMOVING SCALE FROM SHEET METAL

(75) Inventors: Kevin C. Voges, Red Bud, IL (US); Stuart H. Critchley, Dundas (CA); Alan R. Mueth, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 245 days.

(21) Appl. No.: 11/531,907

(22) Filed: Sep. 14, 2006

(65) Prior Publication Data

US 2008/0108281 A1 May 8, 2008

(51) Int. Cl.
*B08B 7/04* (2006.01)
*B24C 1/08* (2006.01)
*B24C 3/08* (2006.01)

(52) U.S. Cl. ..... 134/6; 134/7; 451/39; 451/40; 451/97; 451/98

(58) Field of Classification Search ..... 134/9, 134/15; 451/39, 40, 80, 81, 83, 86, 89, 97, 451/98

See application file for complete search history.

(56) References Cited

U.S. PATENT DOCUMENTS 2,132,311 A * 10/1938 Minich ..... 451/80
2,204,588 A * 6/1940 Guite ..... 451/81
2,429,742 A * 10/1947 Barnes ..... 451/40
2,777,256 A * 1/1957 Paasche ..... 451/81
3,543,775 A 12/1970 Bodnar
3,775,180 A 11/1973 Hirata et al.
3,832,809 A 9/1974 Carpenter, Jr. et al.
3,984,943 A 10/1976 Kono et al.
4,251,956 A * 2/1981 Hirata et al. ..... 451/91
4,269,052 A 5/1981 Imai et al.
4,449,331 A * 5/1984 MacMillan ..... 451/88
4,561,220 A 12/1985 Carpenter et al.
4,723,379 A 2/1988 Macmillan
4,751,798 A 6/1988 McDade
4,768,314 A 9/1988 Thomson
4,907,379 A 3/1990 MacMillan
5,107,629 A * 4/1992 Boyd et al. ..... 451/38
5,554,235 A 9/1996 Noe et al.
5,637,029 A * 6/1997 Lehane ..... 451/39
6,088,895 A 7/2000 Nelson et al.
7,077,724 B1 * 7/2006 Voges ..... 451/38

FOREIGN PATENT DOCUMENTS

JP 2007136469 6/2007

OTHER PUBLICATIONS

International Search Report for PCT/US2009/037055 dated May 5, 2009.

* cited by examiner

*Primary Examiner*—Michael Barr
*Assistant Examiner*—Saeed T Chaudhry
(74) *Attorney, Agent, or Firm*—Thompson Coburn LLP; Matthew J. Himich

(57) ABSTRACT

An apparatus and method of removing scale from the surfaces of processed sheet metal employs a scale removing medium propelled by counter-rotating pairs of wheels positioned in close proximity to the sheet metal surfaces.

29 Claims, 7 Drawing Sheets

SLURRY BLASTING APPARATUS FOR REMOVING SCALE FROM SHEET METAL

BACKGROUND OF THE INVENTION (1) Field of the Invention

The present invention pertains to a process for removing undesirable surface material from flat materials either in sheet or continuous form. In particular, the present invention pertains to an apparatus and method for removing scale from the surfaces of processed sheet metal by propelling a scale removing medium, specifically a liquid/particle slurry, against opposite sides of the sheet metal passed through the apparatus.

(2) Description of the Related Art

Processed sheet metal is sheet metal that has been prepared for use in making cold rolled sheet metal, and for use in manufacturing some goods. Sheet metal of this type is used in the manufacturing of goods that require a full range of steel thicknesses, for example agricultural equipment, automotive parts, steel containers, and bed frames.

Before sheet metal is used by manufacturers it is typically prepared by a hot rolling process. During the hot rolling process, carbon steel is heated to a temperature in excess of 1,500° F. (815° C.). The heated steel is passed through successive pairs of opposing rollers that reduce the thickness of the steel sheet. Once the hot rolling process is completed, the processed sheet metal or hot rolled steel is reduced in temperature, typically by quenching it in water, oil, or a polymer liquid, all of which are well known in the art. The processed sheet metal is then coiled for convenient storage and transportation to the ultimate user of the processed sheet metal, i.e. the manufacturers of aircraft, automobiles, or home appliances, etc.

During the cooling stages of processing the hot rolled sheet metal, reactions of the sheet metal with oxygen in the air and with the moisture involved in the cooling process can result in the formation of an iron oxide layer, or scale as it is commonly referred to, on the surfaces of the sheet metal. The rate at which the sheet metal is cooled, and the total temperature drop from the hot rolling process effect the amount and composition of the scale that forms on the surface during the cooling process.

In most cases before the sheet metal can be used by the manufacturer, the surface of the sheet metal must be conditioned to provide an appropriate surface for the product being manufactured, so that the sheet metal can be painted or otherwise coated for example. The most common method of removing oxide from the surface of hot rolled or processed sheet metal before coating the sheet metal surfaces is a process known as "pickling." In this process of removing oxide, the sheet metal, already cooled to ambient temperature following the hot rolling process, is uncoiled and pulled through a bath of acid to chemically remove the scale formed on the sheet metal surfaces. Following removal of the scale by the acid bath, the sheet metal is then washed, dried, and immediately "oiled" to protect the surfaces of the sheet metal from oxidation or rust. The oil provides a film layer barrier to air that shields the bare metal surfaces of the sheet metal from exposure to atmospheric air and moisture. It is critical that the sheet metal be oiled immediately after the pickling process, because the bare metal surfaces will begin to oxidize almost immediately when exposed to the atmospheric air and moisture.

The "pickling" process is effective in removing substantially all of the oxide layer or scale from processed sheet metal. However, the "pickling" process has a number of disadvantages. For example, the acid used in the acid bath of the sheet metal is corrosive; it is damaging to equipment, it is hazardous to people, and is an environmentally hazardous chemical which has special storage and disposal restrictions. In addition, the acid bath stage of the process requires a substantial area in the sheet metal processing facility.

Thus, there is a need in the industry for an improved apparatus and method for surface conditioning processed sheet metal by removing oxide or scale from the surfaces of the sheet metal, that does not require the manufacturing floor space of the prior art "pickling" process, and does not require the use of a hazardous chemicals such as the acids.

SUMMARY OF THE INVENTION

The present invention overcomes the disadvantages associated with the prior art apparatus and methods employed in removing scale from processed sheet metal by providing a less complex process for removing the scale that does not involve the use of hazardous chemicals. The apparatus of the invention receives previously processed, "i.e. hot rolled" sheet metal and performs the method of the invention to fully remove scale from the sheet metal surfaces. By "sheet metal" what is meant is all forms of sheet metal, for example both strip and sheet materials, of carbon and stainless steels.

The apparatus of the invention may employ a leveler that functions to substantially plane or level the length of sheet metal received from the coil. The leveler could be a tension leveler or a roller leveler, or both.

The length of sheet metal travels from the leveler to a descaler of the apparatus. The descaler includes a plurality of pairs of centrifugal impellers, referred to herein as wheels arranged side by side and spaced above and below the length of sheet metal passing through the descaler. The rotating wheels are supplied with an abrasive scale removing medium, i.e. a liquid and particle slurry. The rotating wheels propel the medium at high speed to the flat surfaces of the length of sheet metal, and the impact of the slurry with the sheet metal removes the scale from the surfaces of the sheet metal as the length of sheet metal passes through the descaler.

The apparatus may optionally also include a brusher or brushing section, following the patent of Voges, U.S. Pat. No. 6,814,815. In most cases there will also be at least one rinsing device that receives the length of sheet metal from the descaler or from the brushing section. The brushing section rotating brushes and rinsing spray impact against the opposite surfaces of the length of sheet metal and assist in the removal of any residual products from the abrasive processing of the descaler. The rotating brushes impacting the opposite surfaces of the sheet metal may also be configured to further condition the surface material or surface texture of the sheet metal surfaces.

The length of sheet metal then passes through a "dryer" that dries or otherwise removes the residual rinsing liquid from the sheet metal.

The dried length of sheet metal could optionally then pass immediately through a coating device, which applies a film of oil, or other protective layer to the dried surfaces of the sheet metal, thereby immediately preventing re-oxidation of the surfaces, and providing lubrication for subsequent processing, and to prevent damage from contact between the two steel surfaces in the coil produced when the dried and oiled length of sheet metal is then passed to a recoiler that winds up the length of sheet metal back into a coil. The descaled and oiled coil of sheet metal is then in a convenient form for storage until needed for subsequent processing.

The full-scale removal process performed by the apparatus of the invention complements other sheet metal processes, for example, the process of the U.S. Patent of Voges U.S. Pat. No. 6,814,815, which removes a controlled fraction of the scale, leaving a corrosion inhibiting surface suitable for many products that do not require full scale removal, such as some zinc coating operations.

The descaling apparatus and its method provide a novel process of removing scale from processed sheet metal that has several commercial advantages over prior art processes. For example compared to the prior art pickling process, the apparatus and its method of operation have a lower operating cost, at the same time no hazardous materials are needed, and no harmful rinse residues are left on the sheet metal. There is no need to vary the processing line speed or other parameters for removing the more stable oxides formed on the sheet metal strip edges, or on the sheet metal coil ends, where the exposure to air or the longer times at elevated temperature support increased oxidation.

The descaling apparatus can be used in a wide operating window, independent of the sheet metal processing line speed, with there being no equivalent defects in the processed sheet metal caused by line stop stain, rinse stain, or over-pickling of the sheet metal that are historically associated with the pickling process. Small surface blemishes such as slivers and seems are removed using the new process. In pickling the loose steel flap often remains on the strip, covering a section of scale. The flaps come free in subsequent rolling, coating or annealing operations, with increased customer liability for the steel processor.

The apparatus and method of the invention also have the potential for one-sided application.

The apparatus of the invention and its method of use can also be used to control the surface texture of the processed sheet metal. The surface texture can be controlled to achieve a target texture using the apparatus of the invention. Texture is a key parameter in higher value added products. Sheet consumers will often specify tight ranges on the Ra and Rpc values for the purchased sheet depending on manufacturing processes and on the end use of the material. A higher Ra value in the 150 micro inch range, may be requested to enhance zinc adherence or coating weight control in medium to heavy coating weight galvanizing lines for example, where a 70 micro inch Ra with high peak count may be requested to enhance the lubrication in drawing or stamping processes, or may be needed to provide an attractive surface after the finish painting.

The apparatus may also be used to achieve different target textures on the opposite surfaces of the sheet metal strip. This is used for instance where an inner surface of a part has a major requirement to carry a heavy coating of lubricant for drawing and then to support a heavy polymer coating for wear and corrosion protection, and the outside surface needs to provide an attractive smooth painted surface. This technique has been used in the past on body panels for luxury automobiles, but would be equally applicable to other applications. The ability to adjust the surface texture of the sheet is important because a rougher surfaced texture normally increases the coating adhesion, but requires more coating. The adjustability feature enables the user of the apparatus to adjust the surface texture for what is more desirable, adhesion or the coating needed.

The apparatus provides a more uniform surface texture than that achievable by pickling the surface of sheet metal which tends to have a mixed topography, particularly in the range of textures referred to as micro-roughness. The apparatus of the invention can be easily adjusted to efficiently accommodate sheet metal strips of different widths. The width of the blast zone in which the slurry contacts the surface of the sheet metal can be reduced for narrower material, but can still essentially use the full design energy of the apparatus wheels, allowing the sheet metal processing line to be operated at higher speeds on narrower materials.

The use of stainless steel particles in the slurry can improve the corrosion behavior of the sheet metal. This is reportedly due to a reduction in the free iron ions on the surface of the metal, resulting in some surface passivation.

When compared to dry blasting sheet metal, the apparatus and method of the invention provides a more consistent performance, because the abrasive particles in the slurry used with the apparatus do not degrade as quickly as do the same or equivalent particles employed in dry blasting. The liquid present in the slurry employed with the apparatus reduces damage caused to the particles of the slurry from incidental, non-targeted impacts between the abrasive particles, which results in a longer useful life of the abrasive particles. Similarly the liquid reduces wear due to contact between the abrasive particles and machine components, which results in a longer useful life of the machine component. Also unlike dry blasting, the apparatus of the invention produces no dust, and thereby provides a more ergonomic work area, reduces the risk of fire, and operates with less noise.

The apparatus of the invention also provides a cleaner strip surface than does dry blasting, which leaves a range of residues on or embedded in the sheet metal surface. These dry blasting residues can include metallic smuts, which are very difficult to remove. In addition, surface contaminants on the sheet metal prior to dry blasting can become embedded in the surface of the sheet metal. Furthermore, unlike dry blasting, wet spots on incoming sheet metal strips do not cause the problem of an agglomeration of loose scale, or wear debris, on the surface of the strip which can result in a further series of defects in the strip. The agglomerated mass could become attached to either the sheet metal strip or to a processing roll in the line.

The problem of dry blasting increasing the temperature in localized areas of the strip which leads to distortion of the strip, and/or flash corrosion of the strip is not experienced in the apparatus of the invention.

The apparatus of the invention can use a wider range of scale removing media, than are practical with dry blasting, for example, a wider range of particle sizes. The apparatus of the invention also increases sheet metal processing options. For example, the slurry can treat the surfaces of the sheet metal with a rust inhibitor used as the liquid in the slurry. A cleaner could also be added to the liquid of the slurry to degrease or clean the surfaces of the sheet metal, allowing reprocessing of defective material produced in other processes.

Compared to other slurry blasting devices, the apparatus of the invention provides a more uniform distribution of the abrasive across the sheet metal width. In the preferred embodiment, each flow stream of slurry propelled by each wheel of the apparatus covers the entire width of the sheet metal.

The apparatus of the invention is also easily adjusted to accommodate different widths of sheet metal. The apparatus has the ability to use its full energy over a wide range of sheet metal widths.

The apparatus is more efficient than air injection slurry blasting systems in energy consumption. The air injection systems have to use multiple discharge nozzles to cover a normal industrial strip width. With the current invention there are no discontinuities where the edges of a slurry blasting pattern of an individual flow contacts the sheet metal, and no discontinuities where individual patterns overlap, or where they begin and end.

The centrifugal impeller strip descaling apparatus of the invention also has less component parts when compared to the other slurry blasting devices. The complexity of most of the individual components of the apparatus is also reduced from that of alternative slurry blasting devices. Furthermore, the relative surface area of the components in contact with moving abrasive, for systems with equivalent total volume flow of slurry is much lower in the configuration of the invention when compared to other slurry blasting devices-resulting in lower overall wear.

BRIEF DESCRIPTION OF THE DRAWINGS

Further features of the apparatus and method of the invention are set forth in the following detailed description of the invention and in the drawing figures.

DETAILED DESCRIPTION OF THE PREFERRED EMBODIMENT

Figure 1:
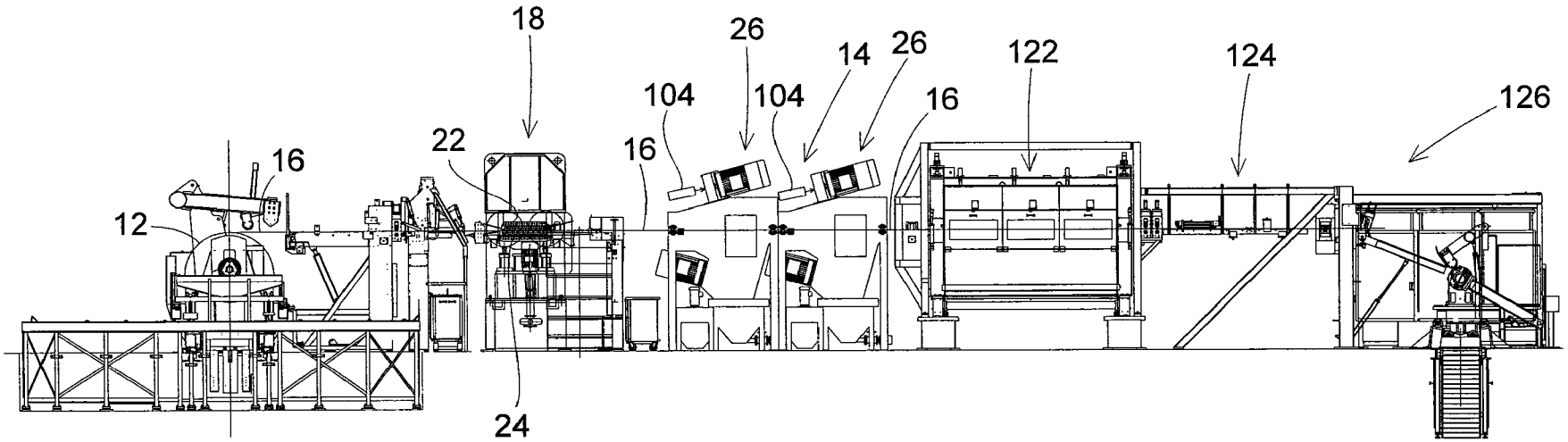
FIG. 1 is a schematic representation of a side elevation view of the processed sheet metal descaling apparatus of the invention and its method of operation.

FIG. 1 shows a schematic representation of the apparatus of the invention that is used to perform the method of the invention in removing scale from the surfaces of processed sheet metal. As will be explained, the sheet metal moves in a downstream direction from left to right through the apparatus shown in FIG. 1. The component parts of the apparatus to be described and shown in FIG. 1 are the preferred embodiment of the invention. It should be understood that variations and modifications could be made to the preferred embodiment to be described without departing from the intended scope of protection provided by the claims of the application.

Referring to FIG. 1, a coil of previously processed sheet metal (for example hot rolled sheet metal) 12 is positioned adjacent the apparatus 14 for supplying a length of sheet metal 16 to the apparatus. The coil of sheet metal 12 may be supported on any conventional device that functions to selectively uncoil the length of sheet metal 16 from the roll 12 in a controlled manner. Alternatively, the sheet metal could be supplied to the apparatus as individual sheets.

A leveler 18 of the apparatus 14 is positioned adjacent the sheet metal coil 12 to receive the length of sheet metal 16 uncoiled from the roll. The Leveler 18 is comprised of a plurality of spaced rolls 22, 24. Although the a roller leveler is shown in the drawing figures, other types of levelers may be employed in the apparatus and process of the invention.

Figure 2:
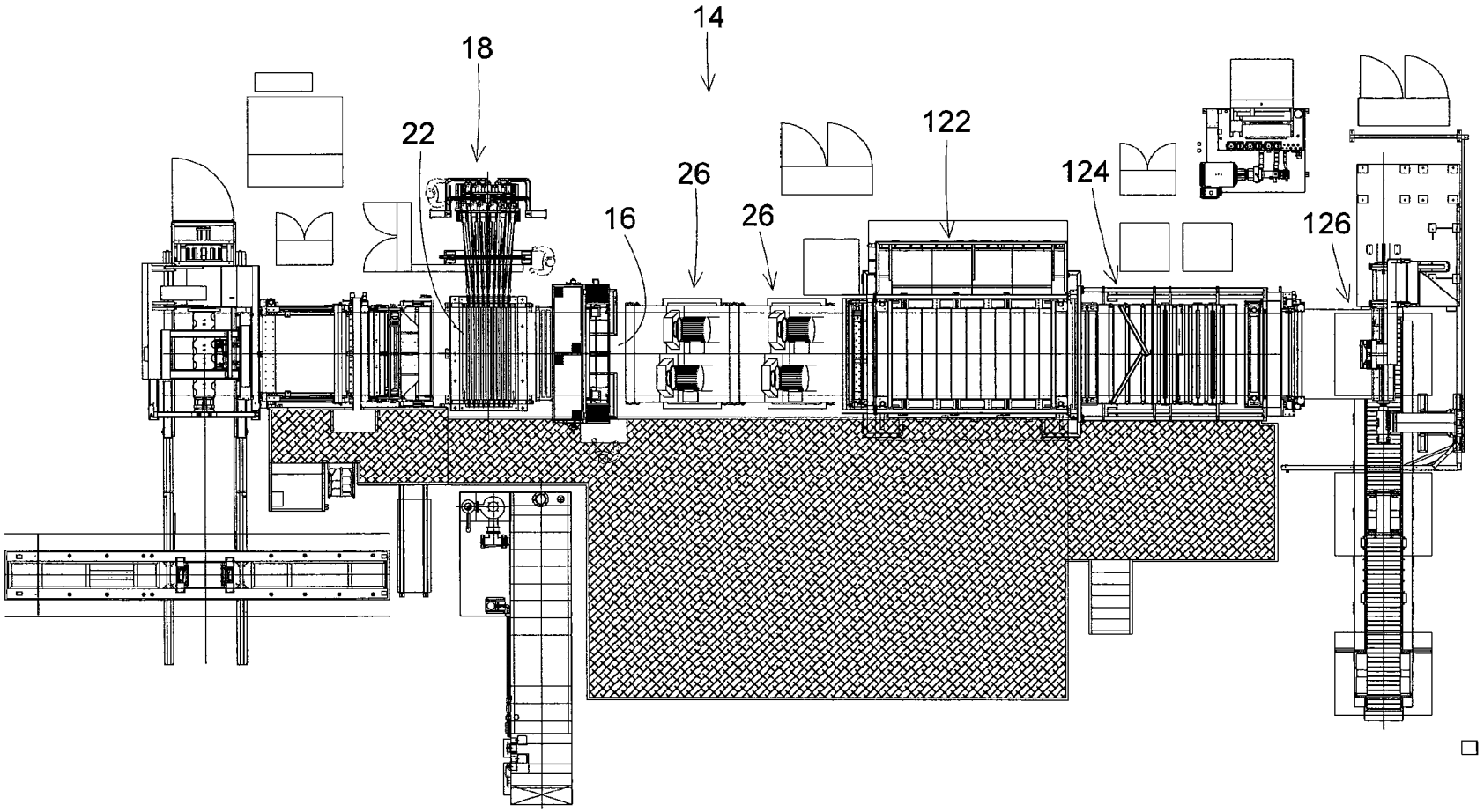
FIG. 2 is a schematic representation of a plan view of the apparatus of FIG. 1.

From the leveler 18, the length of processed sheet metal 16 passes into the descaler 26 of the invention. In FIGS. 1 and 2, a pair of descaler cells 26, consisting of two matched pairs of centrifugal impeller systems, with one pair being installed to process each of the two flat surfaces of the strip are shown sequentially arranged along the downstream direction of movement of the sheet metal 16. Both of the descaler cells 26 are constructed in the same manner, and therefore only one descaler cell 26 will be described in detail. The number of descaler cells is chosen to match the desired line speed of the apparatus, and ensuring adequate removal of scale and subsequent adjustment of surface texture.

Figure 3:
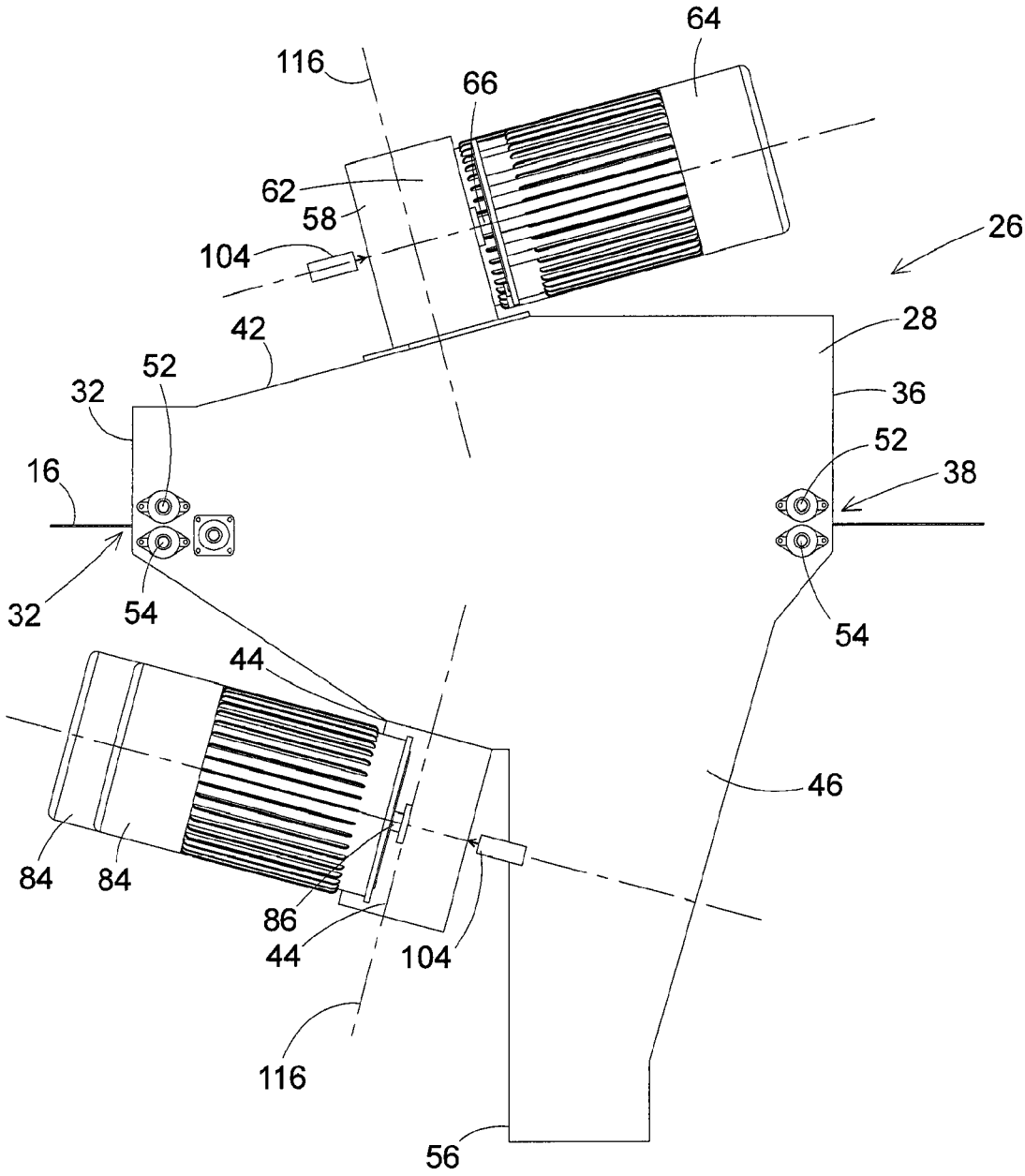
FIG. 3 is a side elevation view of a descaler of the apparatus of FIG. 1.

FIG. 3 shows an enlarged side elevation view of a descaler 26 removed from the apparatus shown in FIGS. 1 and 2. In FIG. 3, the downstream direction of travel of the length of sheet metal is from left to right. The descaler 26 is basically comprised of a hollow box 28. A portion of the length of sheet metal 16 is shown passing through the descaler box 28 in FIGS. 3-5. The length of sheet metal 16 is shown oriented in a generally horizontal orientation as it passes through the descaler box 28. It should be understood that the horizontal orientation of the sheet metal 16 shown in the drawing figures is not necessary for proper operation of the invention. The sheet metal could also be oriented vertically, or at any other orientation as it passes through the descaler apparatus. Therefore, terms such as "top" and "bottom," "above" and "below," and "upper" and "lower" should not be interpreted as limiting the orientation of the apparatus or the orientation of the length of sheet metal for proper operation of the apparatus.

Figure 4:
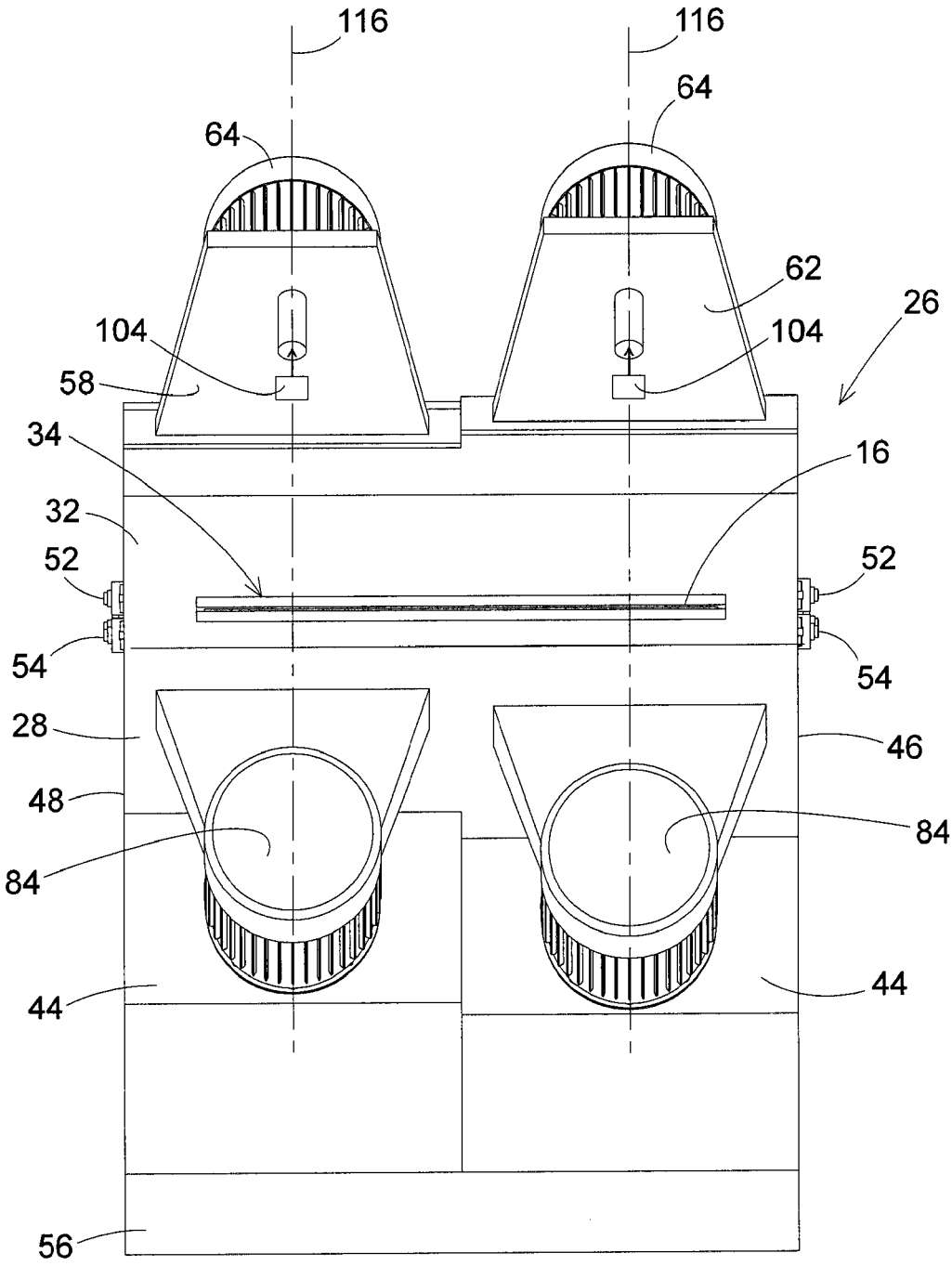
FIG. 4 is an end elevation view of the descaler from an upstream end of the descaler.
Figure 5:
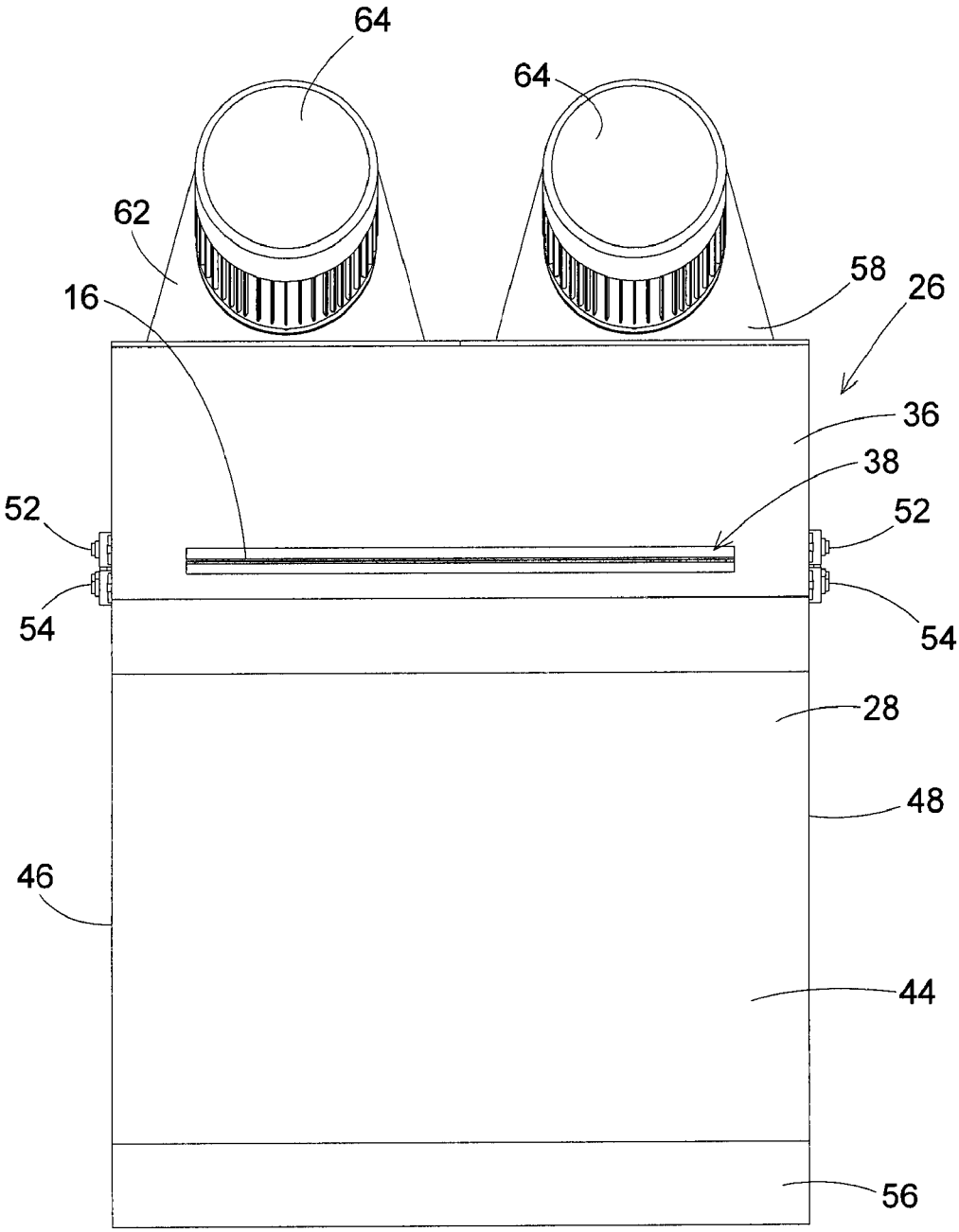
FIG. 5 is an end elevation view of the descaler from the downstream end of the descaler.

An upstream end wall 32 of the box has a narrow entrance opening slot 34 to receive the width and thickness of the length of sheet metal 16. An opposite downstream end wall 36 of the box has a narrow slot exit opening 38 that is also dimensioned to receive the width and thickness of the length of sheet metal 16. The entrance opening 34 is shown in FIG. 4, and the exit opening 38 is shown in FIG. 5. The openings are equipped with sealing devices engineered to contain the slurry within the box during the processing of the strip. The descaler box 28 also has a top wall 42, a series of bottom wall panels 44, and a pair of side walls 46, 48 that enclose the interior volume of the box. For clarity the interior of the box 28 is basically left open, except for pairs of opposed rollers 52, 54 that support the length of sheet metal 16 as the length of sheet metal passes through the box interior from the entrance opening 34 to the exit opening 38. In many cases there will be retracting support devices to assist in threading the ends of strips through the machine. The bottom of the box 28 is formed with a discharge chute 56 having a discharge opening to the interior of the box. The discharge chute 56 allows the discharge of material removed from the length of sheet metal 16 and the collection of used slurry from the interior of the box 28.

A pair of driven centrifugal impellers, 68 are installed in lined casings, shrouds or cowlings 58, 62 which are mounted to the box top wall 42. The shrouds 58, 62 have hollow interiors that communicate through openings in the box top wall 42 with the interior of the box.

As shown in the drawing FIGS. 3-5, the slurry impeller casing shrouds 58, 62 are not positioned side by side, but are positioned on the box top wall 42 in a staggered arrangement. This is done to ensure that the slurry discharging from one impeller does not interfere with the slurry from the other impeller of the pair.

A pair of electric motors 64 is mounted on the pair of shrouds 58, 62. Each of the electric motors 64 has an output shaft 66 that extends through a wall of its associated shroud 58, 62 and into the interior of the shroud. The descaling wheels and their associated shrouds are similar in construction and operation to the slurry discharge heads disclosed in the U.S. Patents of MacMillan U.S. Pat. No. 4,449,331, U.S. Pat. No. 4,907,379, and U.S. Pat. No. 4,723,379; Carpenter et al. U.S. Pat. No. 4,561,220; McDade U.S. Pat. No. 4,751,798; and Lehane U.S. Pat. No. 5,637,029, all of which are incorporated herein by reference.

The slurry is discharged from the impellers in the speed range of 280 feet per minute. A slurry of water and #20 conditioned cut wire shot can used in the first descaler cell, to optimize scale removal from hot rolled carbon steel strip. The resulting surface texture is adjusted by using a range of softer stainless steel shot in the second descaler cell. A blend of #30 and # 10 shot has proven satisfactory. Corrosion inhibitors, for example those marketed under the trademark "Oakite" by Oakite Products, Inc., can be added to the liquid if the product is not to be oiled after processing. The specific products being selected is based on the subsequent use of the sheet being processed and the level of protection required.

If the incoming material has any oil on the surface, commercial alkaline or other cleaning or degreasing agents can be added to the water of the slurry without changing the efficiency of the slurry blasting process. Other abrasive media can be selected for use by those skilled in the art. The average size, the size distribution, the shape, and the material of the abrasive materials to be blended into the slurry mix depend on the material of the strip being processed, and on the desired surface finish/condition.

Rotation of the electric motor shafts 66 rotates the descaling wheels 68 connected to the shafts. Although the electric motors 62 are the preferred motive source for the descaling wheels 68, other means of rotating the descaling wheels 68 may be employed.

A second pair of centrifugal slurry impellers 88 is mounted to bottom wall panels 44 of the descaler box 28. The units will be identical in basic function and size to the top pair.

Both the axes of first pair of impellers 68 and second pair 88, and their assemblies are mounted to the descaler box 28 oriented at an angle relative to the direction of the length of sheet metal 16 passing through the descaler box 28. The axes 98, 102 of the second pair of motors 84 are also oriented at an angle relative to the plane of the length of sheet metal 16 passing through the descaler cell 28. This angle is selected to ensure a stable flow of slurry, to reduce interference between rebounding particles and those that have not yet impacted the strip surface, and to improve the scouring action of the abrasive, to improve effectiveness of material removal, and to reduce the forces that would tend to embed material into the strip that would have to be removed by subsequent impacts.

A supply of a scale removing medium 104 communicates with the interiors of each of the shrouds 58, 62 in the central portion of the descaling wheels 68 and 84 in the same manner described in the earlier-referenced Lehane Patent, or in an other equivalent manner. The scale removing medium in the preferred embodiment of the invention is a slurry of water and fine steel particles. The supply of the scale removing medium 104 is shown schematically in FIG. 3 to represent the various known ways of supplying the different types of abrasive slurry removing medium to the interior of the descaler box 28.

Figure 6:
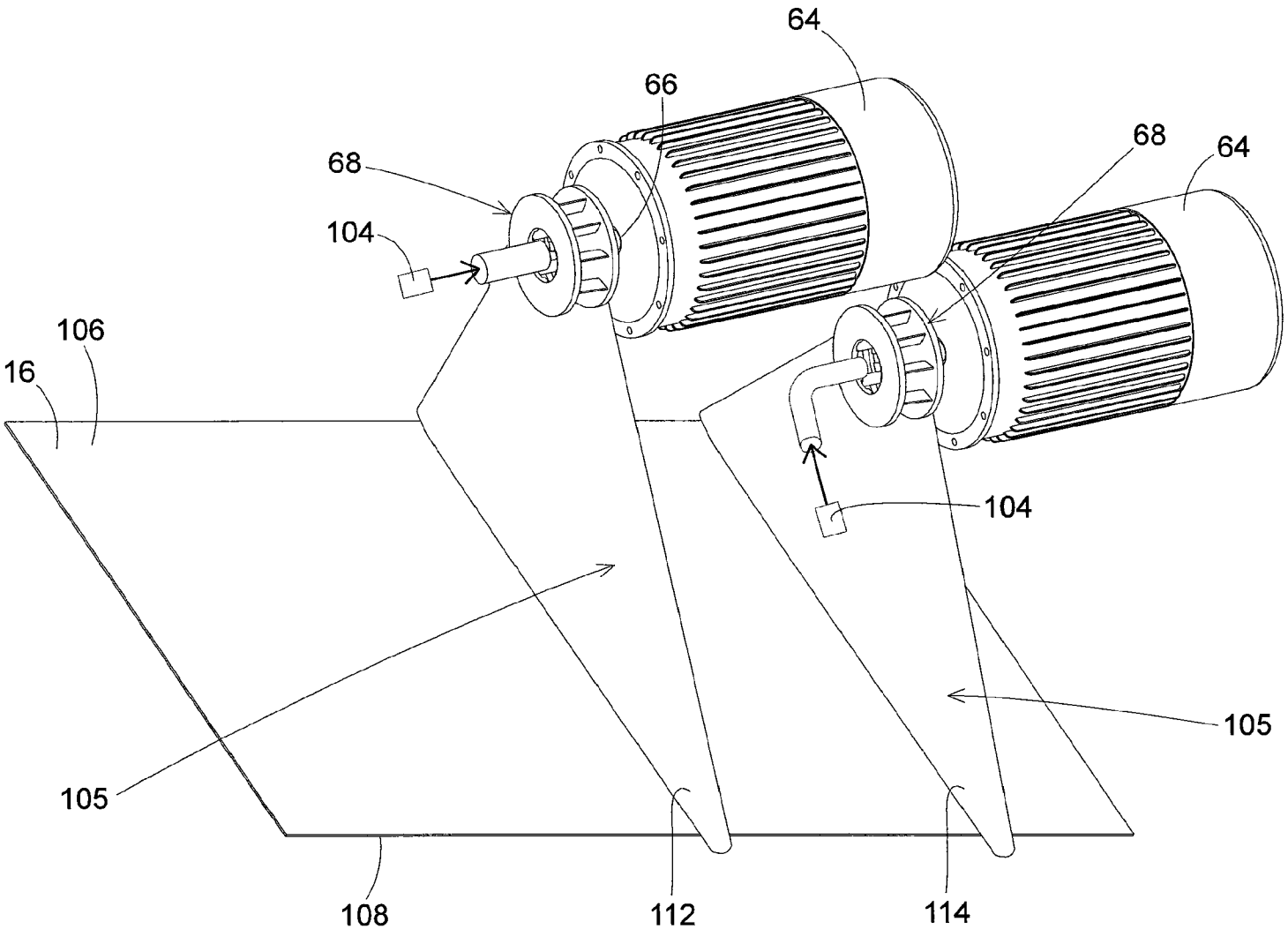
FIG. 6 is a representation of a portion of the descaler shown in FIGS. 4 and 5.

The upper pair of descaling wheels 68 propels the scale removing medium 105 downwardly toward the length of sheet metal 16 passing through the descaler cell 28. Using the concepts of the earlier-referenced patents to effectively target the same areas on the strip for the fluid and solid components of the slurry, the propelled scale removing medium 105 impacts with the top surface 106 of the length of sheet metal 16 and removes scale from the top surface. In the preferred embodiment, the each wheel of any pair of descaling wheels will rotate in opposite directions. For example, as the length of sheet metal 16 moves in the downstream direction, if the descaling wheel 68 on the left side of the sheet metal top surface 106 has a counter-clockwise rotation, then the descaling wheel 68 on the right side of the sheet metal top surface 106 has a clockwise rotation. This causes each of the descaling wheels 68 to propel the scale removing medium 105 into contact with the top surface 106 of the length of sheet metal 16, where the contact area of the scale removing medium 105 propelled by each of the descaling wheels 68 extends entirely across, and slightly beyond the width of the length of sheet metal 16. Allowing the discharge to extend slightly beyond the edges of the strip ensures the most uniform coverage. This is depicted by the two almost rectangular areas of impact 112, 114 of the scale removing medium 105 with the top surface of the length of sheet metal 16 shown in FIGS. 6 and 7. Because the direction of travel of the slurry propelled by wheels relative to the strip width direction varies with the discharge position of the slurry across the wheel diameter, there may be some directionality to the resulting texture for positions of slurry impact most distant from the wheel. This is compensated for in this preferred embodiment of invention by the use of pairs of wheels rotating in opposite directions so that each section of the strip is first subjected to the slurry discharge of the first wheel, then any directional effects due to the first discharged slurry are compensated for by the impacts from the second slurry discharged from the second wheel, which will have counter balancing cross strip velocity components to that of the first slurry discharge.

The axially staggered positions of the upper pair of wheels 68 also axially spaces the two impact areas 112, 114 on the surface 106 of the sheet metal. This allows the entire width of the sheet metal to be impacted by the scale removing medium 105 without interfering contact between the medium 105 propelled from each wheel 68. In addition, the pairs of descaling wheels 68 and 84 could be adjustably positioned toward and away from the surface 106 of the sheet metal passing through the descaler. This would provide a secondary adjustment to be used with sheet metal of different widths. By moving the motors 64 and wheel 68 away from the surface 106 of the sheet metal, the widths of the impact areas 112, 114 with the surface 106 of the sheet metal is increased. By moving the motors 64 and their wheels 68 toward the surface 106 of the sheet metal, the widths of the impact areas 112, 114 with the surface 106 of the sheet metal is decreased. This adjustable positioning of the motors 64 and their descaling wheels 68 enables the apparatus to be used to remove scale from different widths of sheet metal. An additional method of width adjustment of the area of slurry impact with the sheet metal surface is to move the angular position of the inlet nozzles 104 relative to the impeller casing/shroud. This is explained in the earlier-referenced patents. A third option is to rotate the pair of impellers about axes 116 normal to their rotation axes relative to the strip travel direction so that the oval area of slurry impact from each wheel, although staying the same length, would not be square or transverse to the strip travel direction. The movement away and toward the strip will change the impact energy of the flow also.

In addition, the angled orientation of the axes 78, 82 of the descaling wheels 68 also causes the impact of the scale removing medium 105 to be directed at an angle relative to the surface of the sheet metal 16. The angle of the impact of the scale removing medium 105 with the surface of the sheet metal 16 is selected to optimize the effectiveness of the scale. An angle of 15 degrees has been proven satisfactory.

In addition, adjusting the characteristics of the scale removing medium 104 can be used to adjust the surface texture of the strip of sheet metal passing through the descaling apparatus. For example, adjusting combinations of the size of the particles, the shape of the particles, or the material of the particles in the slurry of the scale removing medium 104 can produce different desired surface textures on the sheet metal.

Figure 7:
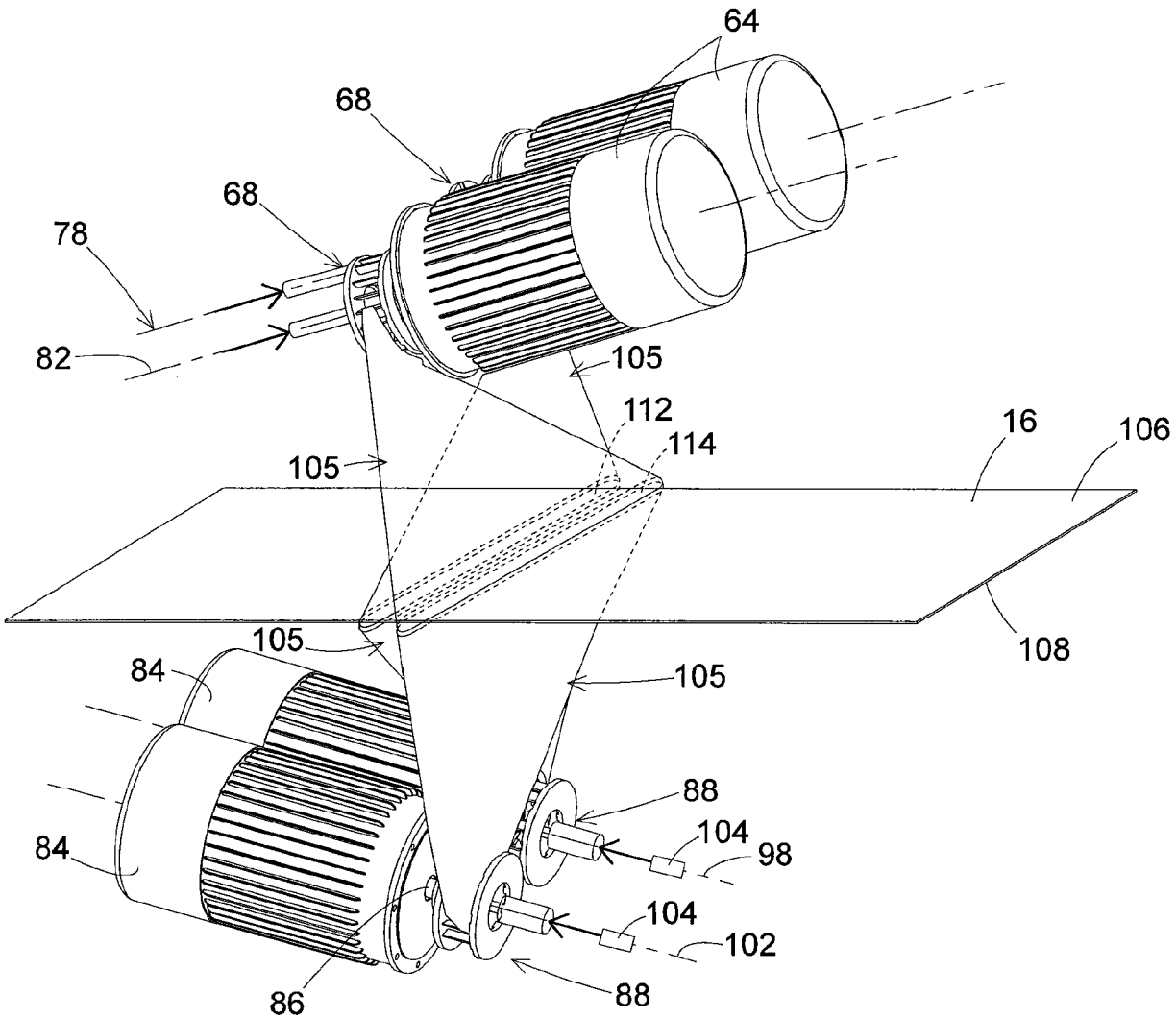
FIG. 7 is a representation of a further portion of the descaler shown in FIGS. 4 and 5.

As shown in FIGS. 3 and 7, the lower pair of descaling wheels 88, direct the scale removing slurry 105 to impact with the bottom surface 108 of the length of sheet metal 16 in the same manner as the top pair of descaling wheels 68. In this configuration the areas of impact of the scale removing medium 105 on the bottom surface 108 of the length of sheet metal 16 is directly opposite the areas of impact 112, 114 on the top surface of the sheet metal. This balances the strip loads from the top and bottom streams of slurry to improve line tension stability. Thus, the bottom descaling wheels 88 function in the same manner as the top descaling wheels 68 to remove scale from the bottom surface 108 of the sheet metal 16 passed through the descaler 26.

In the embodiment of the apparatus processing line shown in FIGS. 1 and 2, two blasting cells 26 are positioned sequentially in the path of the sheet metal 16 passing through the line of the apparatus. On exiting the two cells 26, the sheet metal 16 can be further conditioned.

A brusher 122 is positioned adjacent the blasting cell 26 to receive the length of sheet metal 16 from the descalers. The brusher 122 could be of the type disclosed in the U.S. Patent of Voges U.S. Pat. No. 6,814,815, which is incorporated herein by reference. The brusher 122 comprises pluralities of rotating brushes arranged across the width of the sheet metal 16. The rotating brushes contained in the brusher 122 contact the opposite top 106 and bottom 108 surfaces of the length of sheet metal 16 as the sheet metal passes through the brusher 122, and produce a unique brushed and blasted surface, generally with a lower roughness, with some directionality. The brushes act with water sprayed in the brusher 122 to process the opposite surfaces of the sheet metal, adjusting or modifying the texture of the surfaces created by the blasting cells 26.

A dryer 124 is positioned adjacent the brusher 122 to receive the length of sheet metal 16 from the brusher, or directly from the slurry blaster if the brushing unit is not installed or is deselected. The dryer 124 dries the liquid from the surfaces of the length of sheet metal 16 as the sheet metal passes through the dryer. The liquid is residue from the rinsing process.

A coiler 126 receives the length of sheet metal 16 from the dryer 124 and winds the length of sheet metal into a coil for storage or transportation of the sheet metal.

In alternative line configurations/embodiments, the length of sheet metal processed by the apparatus may be further processed by a coating being applied to the surfaces of the sheet metal, for example a galvanizing coating or a paint coating.

The length of sheet metal could also be further processed by running the length of sheet metal through the line apparatus shown in FIGS. 1 and 2 a second time.

It should also be appreciated that the opposite surfaces of the length of sheet metal could be processed by the apparatus differently, for example by employing different scale removing medium supplied to the wheels above and below the length of sheet metal passed through the apparatus.

The descalers of the apparatus could also be positioned at different positions in a line other than those shown in FIGS. 1 and 2. For example, the descalers could be positioned after the brushers.

The descaler apparatus 14 described above provides a means of substantially removing all scale from processed sheet metal (i.e., sheet metal that has been previously hot rolled or otherwise processed) that requires less manufacturing floor space and less expense than prior art descaling processes, primarily pickling.

Summarizing the basic process of the invention, the length of processed sheet metal is first leveled making the surfaces of the length of sheet metal substantially flat.

The length of sheet metal is then descaled by subjecting the opposite top and bottom surfaces of the length of sheet metal to slurry blasting using at least one centrifugal impeller, and a recirculating slurry system, normally, a water and particle slurry. The slurry is propelled against the surfaces of the sheet metal to remove scale from the opposite, top and bottom, surfaces of the length of sheet metal.

The water remaining on the length of the sheet metal is then dried from the opposite top and bottom surfaces. The descaled sheet metal could then optionally be oiled, and is then wound into a coil for storage or transportation of the sheet metal.

Additional features of the method of the invention include brushing the opposite top and bottom surfaces after the descaling process. The brushing does secondary processing of the opposite top and bottom surfaces of the length of sheet metal, and conditions the surfaces by adjusting the texture resulting from the descaling, and provides an option of producing two product families from the same apparatus.

The process of the invention has the further benefit of being completely environmentally friendly, i.e. not requiring the dangerous chemicals of the prior art pickling process. The apparatus and the method of the invention also require only about 100 feet of line floor space, versus 500 feet of line floor space typically required for a pickling process.

Although the apparatus and the method of the invention have been described herein by referring to a preferred embodiment of the invention, it should be understood that variations and modifications could be made to the basic concept of the invention without departing from the intended scope of the following claims.

The invention claimed is:

1. An apparatus that removes scale from sheet metal, the apparatus comprising:

a descaler that receives lengths of sheet metal and removes scale from at least one surface of the length of sheet metal as the length of sheet metal is moved in a first direction through the descaler;

a supply of a scale removing medium communicating with the descaler and supplying the scale removing medium to the descaler, the scale removing medium comprising a liquid and grit based particle slurry;

a pair of wheels on the descaler positioned adjacent the at least one surface of the length of sheet metal passed through the descaler, a first wheel and a second wheel of the pair of wheels having respective first and second axes of rotation, the first wheel and the second wheel being positioned on the descaler to receive the scale removing medium from the supply of scale removing medium; and, at least one motive source operatively connected to the first wheel and the second wheel to rotate the first wheel and the second wheel whereby rotation of the first wheel causes the scale removing medium received by the first wheel to be propelled from the first wheel against the at least one surface across substantially an entire width of the length of sheet metal passed through the descaler and rotation of the second wheel causes the scale removing medium received by the second wheel to be propelled from the second wheel against the at least one surface across substantially an entire width of the length of sheet metal passed through the descaler;

wherein the first wheel rotates in a first rotary direction and the second wheel rotates in a second rotary direction, the first rotary direction being opposite to the second direction;

wherein the second wheel is spaced from the first wheel along the first direction a distance sufficient such that the scale removing medium propelled from the second wheel does not substantially interfere with the scale removing medium propelled from the first wheel; and wherein the first wheel and the second wheel are positioned adjacent opposite side edges defining the width of the sheet metal with the sheet metal centered between the first wheel and the second wheel.

2. The apparatus of claim 1, further comprising:

the first wheel being adjustably positioned on the descaler for movement toward and away from the length of sheet metal passed through the descaler; and, the second wheel being adjustably positioned on the descaler for movement toward and away from the length of sheet metal passed through the descaler.

3. The apparatus of claim 1, further comprising:

the first wheel and the second wheel being equidistant from the length of sheet metal.

4. The apparatus of claim 1, further comprising:

the descaler being part of a sheet metal processing line that includes a brusher that receives the length of sheet metal from the descaler.

5. The apparatus of claim 1, further comprising:

the descaler being part of the sheet metal processing line that also includes a dryer that receives the length of sheet metal from the brusher.

6. The apparatus of claim 1, further comprising:

the descaler being positioned adjacent the one surface of the length of sheet metal and a brusher being positioned adjacent an opposite side of the length of sheet metal.

7. The method of claim 4, further comprising:

combining the first wheel and the second wheel with a rotating brush and reducing surface roughness and selectively removing layers of scale from the length of sheet metal using the brush.

8. A method of removing scale from a length of sheet metal comprising:

positioning a first wheel having a first axis of rotation adjacent a first surface of the length of sheet metal;

positioning a second wheel having a second axis of rotation adjacent the first surface of the length of sheet metal;

supplying a scale removing medium to the first wheel and to the second wheel as a slurry comprising liquid and grit particles;

rotating the first wheel about the first rotation axis whereby the scale removing medium supplied to the first wheel is propelled by the rotating first wheel against a first area extending across substantially an entire width of the first surface of the length of sheet metal;

rotating the second wheel about the second rotation axis whereby the scale removing medium supplied to the second wheel is propelled by the rotating second wheel against a second area of the first surface extending across substantially an entire width of the length of sheet metal;

rotating the first wheel and the second wheel in opposite directions;

positioning the first wheel and the second wheel relative to the length of sheet metal where the first area is spaced from the second area along the length of sheet metal; and positioning the first wheel and the second wheel along adjacent opposite side edges defining a width of the sheet metal with the sheet metal centered between the first wheel and the second wheel.

9. The method of claim 8, further comprising:

moving the length of sheet metal in an axial direction through the scale removing medium propelled by the first wheel and the second wheel to descale and clean the length of sheet metal.

10. The method of claim 9, further comprising:

adjustably positioning the first wheel and the second wheel toward and away from the length of sheet metal to adjust a surface finish of the length of sheet metal.

11. The method of claim 8, further comprising:

combining the first wheel and the second wheel with a sheet metal brushing apparatus and fully descaling the length of sheet metal and adjusting a surface texture of the length of sheet metal using the brushing apparatus.

12. The method of claim 8, further comprising:

combining the first wheel and the second wheel with a sheet metal brushing apparatus, and fully descaling the length of sheet metal and adjusting a surface texture of the length of sheet metal using different slurries with the first wheel and the second wheel and using the brushing apparatus.

13. The method of claim 8, further comprising:

combining the first wheel and the second wheel with a sheet metal brushing apparatus, and selectively removing layers of scale from the length of sheet metal and adjusting a surface texture of the length of sheet metal by selectively using different combinations of the first wheel and the second wheel and the brushing apparatus.

14. The method of claim 13, further comprising:

using the brushing apparatus to brush only one side of a length of sheet metal and using the first wheel and the second wheel to propel slurry against only the opposite side of a length of sheet metal.

15. The method of claim 13, further comprising:

using the brushing apparatus to brush opposite sides of the length of sheet metal and using the first wheel and the second wheel to propel slurry against only one side of a length of sheet metal.

16. The method of claim 8, further comprising:

reversing a direction of movement of the length of sheet metal through the apparatus to provide a range of surface finishes on the length of sheet metal.

17. The method of claim 8, further comprising:

combining the first wheel and the second wheel with a sheet metal brushing apparatus and with at least one sheet metal leveler.

18. The method of claim 8, further comprising:

adjusting rotation of the first wheel and second wheel to vary surface roughness of the length of sheet metal.

19. The method of claim 8, further comprising:

combining the first wheel and the second wheel on one side of the length of sheet metal with a third wheel and a fourth wheel on an opposite side of the length of sheet metal to produce a rough surface on the one side of the length of sheet metal and a smooth surface on the opposite side of the length of sheet metal.

20. An apparatus that removes scale from sheet metal, the apparatus comprising:

a descaler that receives a length of sheet metal, the sheet metal having a width that is transverse to the sheet metal length, the descaler being operable to remove scale from a top surface and a bottom surface of the length of sheet metal completely across the width of the length of sheet metal as the length of sheet metal passes through the descaler;

a scale removing, liquid slurry supply communicating with the descaler and supplying the liquid slurry to the descaler and removing and recirculating the liquid slurry supplied to the descaler;

a first rotatable impeller wheel having an axis of rotation, the wheel being positioned on the descaler to receive the slurry supplied by the liquid slurry supply and centrifugally propel the slurry against the top surface of the length of sheet metal in an impact area that extends completely across the width of the length of sheet metal as the length of sheet metal passes through the descaler;

a second rotatable impeller wheel having an axis of rotation different from the first rotatable impeller wheel axis of rotation, the second rotatable impeller wheel being positioned on the descaler to receive the slurry supplied by the liquid slurry supply and centrifugally propel the slurry against the top surface of the length of sheet metal in an impact area that extends completely across the width of the length of sheet metal as the length of sheet metal passes through the descaler;

a third rotatable impeller wheel having an axis of rotation, the wheel being positioned on the descaler to receive the slurry supplied by the liquid slurry supply and centrifugally propel the slurry against the bottom surface of the length of sheet metal in an impact area that extends completely across the width of the length of sheet metal as the length of sheet metal passes through the descaler;

a fourth rotatable wheel having an axis of rotation different from the third rotatable wheel axis of rotation, the fourth rotatable wheel being positioned on the descaler to receive the slurry supplied by the liquid slurry supply and centrifugally propel the slurry against the bottom surface of the length of sheet metal in an impact area that extends completely across the width of the length of sheet metal as the length of sheet metal passes through the descaler;

wherein the first and second wheels are positioned as symmetrical mirror images across the width of the length of the top surface of the sheet metal and centrifugally propel the slurry against the top surface of the length of sheet metal in symmetrical, mirror image patterns of propelled slurry across the width of the length of sheet metal;

wherein the third and fourth wheels are positioned as symmetrical mirror images across the width of the length of the bottom surface of the sheet metal and centrifugally propel the slurry against the bottom surface of the length of sheet metal in symmetrical, mirror image patterns of propelled slurry across the width of the length of sheet metal;

wherein the second wheel is spaced from the first wheel along the length of the sheet metal a distance sufficient such that the liquid slurry propelled from the second wheel does not substantially interfere with the liquid slurry propelled from the first wheel; and wherein the first wheel and the second wheel are positioned adjacent opposite side edges of the width of sheet metal with the sheet metal centered between the first wheel and the second wheel;

wherein the third wheel is spaced from the fourth wheel alone the first direction a distance sufficient such that the liquid slurry propelled from the third wheel does not substantially interfere with the liquid slurry propelled from the fourth wheel; and wherein the third wheel and the fourth wheel are positioned adjacent opposite side edges of the width of sheet metal with sheet metal centered between the third wheel and the fourth wheel.

21. The apparatus of claim 20, further comprising:

at least one of the first, second, third and fourth wheels being movable toward and away from a respective surface of the length of sheet metal to adjust an intensity of the impact and the impact area.

22. The apparatus of claim 20, further comprising:

the descaler being part of a sheet metal processing line that includes a brushing apparatus to further remove scale from the length of sheet metal, remove debris of the slurry from the length of sheet metal, and adjust a surface texture of the length of sheet metal.

23. The apparatus of claim 20, further comprising:

the descaler being part of a sheet metal processing line that includes a sheet metal rolling apparatus and a sheet metal coating apparatus.

24. The apparatus of claim 20, further comprising:

the first and second pair of rotatable wheels being positioned on opposite sides of the length of sheet metal and having slurry impacting areas on aligned, directly opposite surfaces of the length of sheet metal to minimize deflection of the length of sheet metal.

25. A method of slurry blasting metal comprising:

positioning a first wheel having a first axis of rotation adjacent a first surface of a metal object;

positioning a second wheel having a second axis of rotation adjacent the first surface of the metal object, the second axis of rotation being different from the first axis of rotation;

supplying a slurry to the first wheel and the second wheel; and, rotating the first and second impeller wheels about the respective first and second axes of rotation in a manner such that the slurry supplied to the first and second impeller wheels is propelled by the rotating first and second impeller wheels against a respective first area and second area of the first surface of the metal object;

positioning a third impeller wheel having a third axis of rotation adjacent a second surface of the metal object that is opposite the first surface of the metal object;

positioning a fourth impeller wheel having a fourth axis of rotation adjacent the second surface of the metal object, the fourth axis of rotation being different from the third axis of rotation;

supplying the slurry to the third wheel and the fourth wheel; and rotating the third wheel and the fourth impeller wheel about the respective third and fourth axes of rotation in a manner such that the slurry supplied to the third and fourth impeller wheels is propelled by the rotating third and fourth impeller wheels against a respective third area and fourth area of the second surface of the metal object;

wherein the first and second impeller wheels are positioned such that the first and second areas are symmetrical mirror images across a width of the sheet metal, and the third and fourth impeller wheels are positioned such that the third and fourth areas are symmetrical mirror images across a width of the second surface of the sheet metals;

wherein the second wheel is spaced from the first wheel along the length of the first surface of the sheet metal a distance sufficient such that the slurry propelled from the second wheel does not substantially interfere with the slurry propelled from the first wheel; and wherein the first wheel and the second wheel are positioned adjacent opposite side edges defining the width of the sheet metal with the sheet metal centered between the first wheel and the second wheel;

wherein the third wheel is spaced from the fourth wheel along the length of the sheet metal a distance sufficient such that the slurry propelled from the third wheel does not substantially interfere with the slurry propelled from the fourth wheel; and wherein the third wheel and the fourth wheel are positioned adjacent opposite side edges defining the width of the sheet metal with the sheet metal centered between the third wheel and the fourth wheel.

26. The method of claim 25, further comprising:

adjusting rotation of the first wheel and the second wheel to vary surface roughness of the first surface of the metal object.

27. The method of claim 25, further comprising:

producing a rough surface on the first surface of the metal object by the slurry propelled against the first surface and producing a smooth surface on the second surface of the metal object by the slurry propelled against the second surface.

28. The method of claim 25, further comprising:

combining the first wheel and the second wheel with a rotating brush and reducing surface roughness and selectively removing layers of scale from the metal object using the brush.

29. The method of claim 25, further comprising:

positioning a brusher adjacent a second surface of the metal object that is opposite the first surface; and, brushing the second surface of the metal object with the brusher.

* * * * *